US011402777B2

(12) United States Patent
Hirst et al.

(10) Patent No.: US 11,402,777 B2
(45) Date of Patent: Aug. 2, 2022

(54) FUSING COMPONENTS INCLUDING HEATING ELEMENTS OF DIFFERING LENGTHS

(71) Applicant: Hewlett-Packard Development Company, L.P., Spring, TX (US)

(72) Inventors: Bartley Mark Hirst, Boise, ID (US); Mark J. Wibbels, Boise, ID (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/256,416

(22) PCT Filed: Oct. 26, 2018

(86) PCT No.: PCT/US2018/057801
§ 371 (c)(1),
(2) Date: Dec. 28, 2020

(87) PCT Pub. No.: WO2020/086098
PCT Pub. Date: Apr. 30, 2020

(65) Prior Publication Data

US 2021/0271191 A1 Sep. 2, 2021

(51) Int. Cl.
*G03G 15/20* (2006.01)

(52) U.S. Cl.
CPC ..... *G03G 15/2039* (2013.01); *G03G 15/20* (2013.01); *G03G 15/2017* (2013.01); *G03G 2215/2003* (2013.01)

(58) Field of Classification Search
CPC ..... G03G 15/2042; G03G 2215/2035; G03G 15/2053; G03G 15/2039
See application file for complete search history.

(56) References Cited

U.S. PATENT DOCUMENTS

| | | | | |
|---|---|---|---|---|
| 6,011,939 | A | 1/2000 | Martin | |
| 6,882,804 | B2 | 4/2005 | Eskey | |
| 6,901,226 | B2 | 5/2005 | Claassen | |
| 7,193,180 | B2 | 3/2007 | Cook et al. | |
| 7,738,805 | B2 | 6/2010 | Lofthus et al. | |
| 9,201,366 | B2 | 12/2015 | Creteau et al. | |
| 9,417,572 | B2 | 8/2016 | Hamilton et al. | |
| 2006/0045591 | A1 | 3/2006 | Chae et al. | |
| 2010/0142986 | A1* | 6/2010 | Davidson | G03G 15/2042 399/334 |
| 2012/0155937 | A1* | 6/2012 | Hamilton | G03G 15/2042 399/333 |
| 2013/0302060 | A1* | 11/2013 | Moriya | G03G 15/80 399/90 |
| 2015/0086231 | A1* | 3/2015 | Bush | G03G 15/2042 399/69 |
| 2017/0102650 | A1 | 4/2017 | Shimura et al. | |
| 2017/0336743 | A1 | 11/2017 | Hopkins et al. | |
| 2018/0059591 | A1 | 3/2018 | Cao | |

* cited by examiner

*Primary Examiner* — Jessica L Eley
(74) *Attorney, Agent, or Firm* — Mannava & Kang

(57) ABSTRACT

According to examples, an apparatus may include a fusing component and a heater disposed in the fusing component. The heater may include a substrate having a first surface and a second surface, a first heating element having a first length attached to the first surface of the substrate, and a second heating element having a second length attached to the second surface of the substrate, the second length differing from the first length.

15 Claims, 5 Drawing Sheets

FUSING COMPONENTS INCLUDING HEATING ELEMENTS OF DIFFERING LENGTHS

BACKGROUND

A fusing apparatus may be used in imaging processes of printers, copiers, and the like, to apply heat and pressure to fix printing material, such as, toner, onto a medium, such as paper. The fusing apparatus may include multiple rollers, belts, or combinations thereof to form a nip therebetween. One of the rollers may be heated to apply heat onto the printing material and the printing material may be fused to the medium as the medium is moved through the nip.

BRIEF DESCRIPTION OF THE DRAWINGS

Features of the present disclosure are illustrated by way of example and not limited in the following figure(s), in which like numerals indicate like elements, in which.

DETAILED DESCRIPTION

Figure 1A:
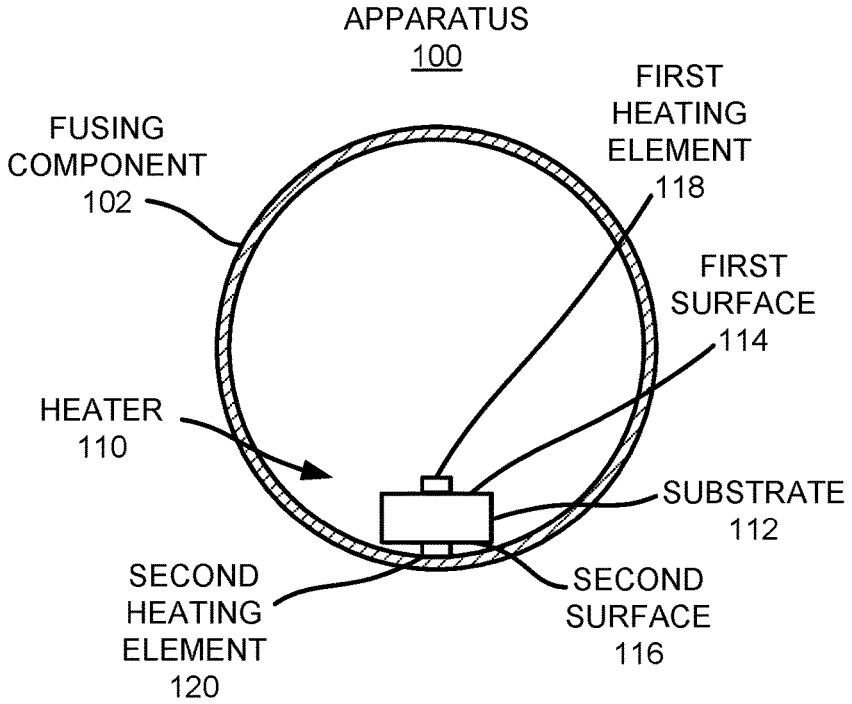
FIG. 1A shows a cross-sectional side view of an example apparatus having a fusing component and a heater.

Fusing apparatuses for printing systems may allow for "instant-on" fusing where a fuser in a fusing apparatus has a relatively short warm up time, thereby reducing electrical energy consumption and printing time. The fuser may have a heating region that may be sufficiently long to fuse the widest media that a printing mechanism may print. In some instances, an overheating problem may occur when a narrow medium is heated in the fusing apparatus. For instance, in regions of the fuser nip where the medium does not pass, the fuser and a backup roll may exceed desired temperatures and may be damaged due to the high temperature. In addition, heating regions of the fuser that do not heat regions of the medium may result in wasted energy.

Disclosed herein are apparatuses, systems, and methods for efficiently fixing printing material onto a medium through application of heat and pressure onto the printing material. Particularly, the apparatuses disclosed herein may include a fusing component and a heater disposed in the fusing component. The heater may have a substrate having a first surface and a second surface, in which a first heating element having a first length may be attached to the first surface of the substrate and a second heating element having a second length may be attached to the second surface of the substrate. In some examples, the substrate may have a rectangular cross section and the second surface may be located on an opposite side of the substrate from the first surface. In some examples, additional heating elements may be attached to the first surface and/or the second surface.

The heating elements may be resistive heating elements, in which the heating elements may be formed of resistors or resistive materials and may become heated as electrical energy is applied through the heating elements. In addition, the substrate may be formed of a thermally conductive and electrically nonconductive material, such as ceramic or the like. The substrate may also be formed to have a relatively short distance between the first surface and the second surface such that, when electrical energy is applied across a heating element attached to the first surface of the substrate, heat generated by the heating element may be conducted through the substrate and to the second surface of the substrate.

According to examples, electrical energy may individually and selectively be applied across each of the heating elements. That is, a controller may select one of the heating elements to receive the electrical energy based, for instance, on a width of the medium, a coverage of the printing material to be applied or applied on the medium, and/or the like. Particularly, the controller may select the heating element having a length that covers the width of the medium and/or the width of the printing material applied on or to be applied on the medium with a minimum amount of extra length. In other words, the controller may select the heating element having a length that most closely matches the width of the medium and/or the width of the coverage of the printing material on the medium without being shorter than either or both of the widths.

Through implementation of the apparatuses, systems, and methods disclosed herein, a heater may apply heat across a number of media widths and/or printing material coverages. By selecting the heating element as disclosed herein, the amount of excess heat generated by the heater may be minimized. That is, the heater may be controlled to generate heat at a region of a fusing component that is to contact the media and/or the printing material applied on the media without generating excess heat outside of that region. As a result, the printing material may be fixed to media while minimizing energy consumption and minimizing excess heat generation, which may preserve the useful life of a fusing apparatus employing the heater disclosed herein.

In addition, through placement of the first heating element on the first surface of the substrate and the second heating element on the second surface of the substrate, the substrate may be formed to have a relatively small cross-sectional area. As a result, the substrate may have a relatively small mass, which may facilitate thermal conduction through the substrate and thus the efficiency of heat conduction from the heating elements to the fusing component.

Before continuing, it is noted that as used herein, the terms "includes" and "including" mean, but is not limited to, "includes" or "including" and "includes at least" or "including at least." The term "based on" means "based on" and "based at least in part on."

Figure 1B:
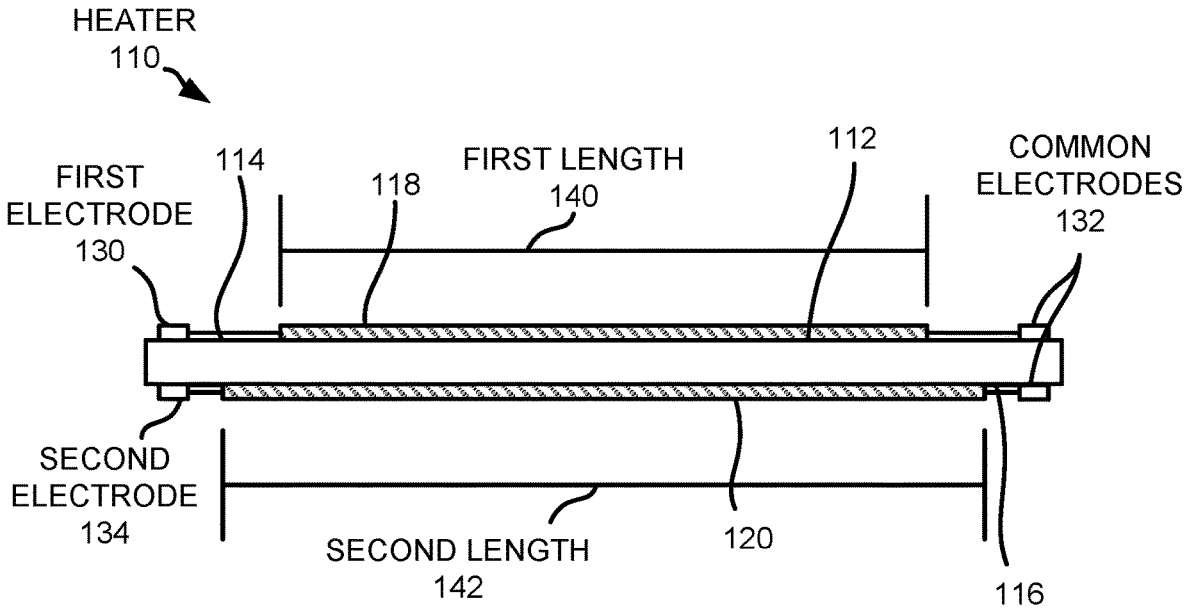
FIG. 1B shows a front view of the example heater depicted in FIG. 1A.
Figure 2:
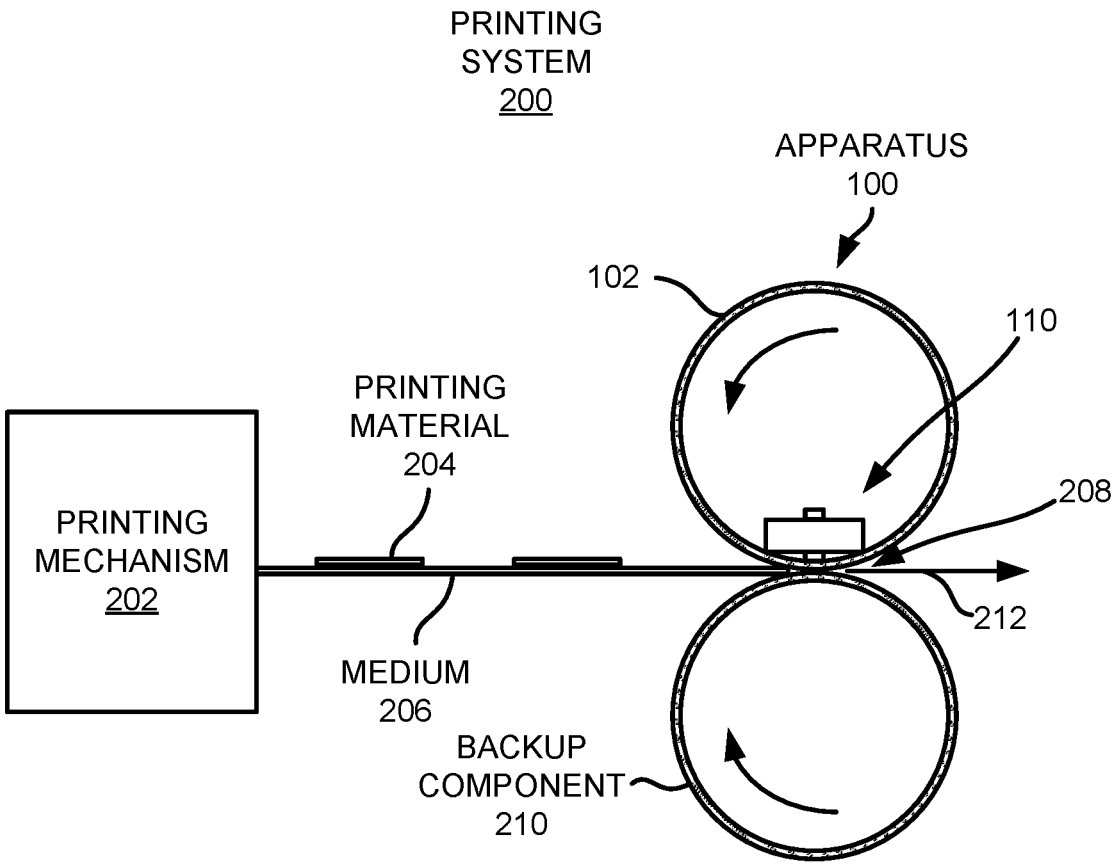
FIG. 2 depicts a diagram of an example printing system including the example apparatus depicted in FIG. 1A.

Reference is first made to FIGS. 1A, 1B and 2. FIG. 1A shows a cross-sectional side view of an example apparatus 100 having a fusing component 102 and a heater 110. FIG. 1B shows a front view of the example heater 110 depicted in FIG. 1A. FIG. 2 depicts a diagram of an example printing system 200 including the example apparatus 100 depicted in FIG. 1A. It should be understood that the example apparatus 100 depicted in FIG. 1A, the example heater 110 depicted in FIG. 1B, and the example printing system 200 depicted in FIG. 2 may include additional components and that some of the components described herein may be removed and/or modified without departing from the scopes of the example apparatus 100, the example heater 110, and/or the example printing system 200 disclosed herein.

The printing system 200, which may be a printer, a copier, a facsimile machine, or the like, may include the apparatus 100, which may be a fusing apparatus of the printing system 200. The printing system 200 may also include a printing mechanism 202 that may apply printing material 204 onto a medium 206, for instance, into a particular design and/or as text. The printing material 204 may be, for instance, toner, or other suitable printing material, and the medium 206 may be, for instance, paper, cardboard, an envelope, or the like. The printing mechanism 202 may include suitable printing components to apply printing material 204 onto the medium 206.

As shown, following application of the printing material 204 onto the medium 206, the medium 206 may be moved through a nip 208 formed between the apparatus 100 and a backup component 210. As discussed herein, the apparatus 100 may be heated to apply heat onto the printing material 204 as the medium 206 is moved through the nip 208. In addition, the apparatus 100 and the backup component 210 may apply pressure on the printing material 204 and the medium 206 as the apparatus 100 and the backup component 210 are rotated. As the apparatus 100 and the backup component 210 are rotated, the medium 206 may be moved through the nip 208 as denoted by the arrow 212.

As shown in FIGS. 1A and 1B, the apparatus 100 may include a fusing component 102 and a heater 110. The fusing component 102 may be a hollow cylinder, a roller, a belt, or the like. In addition, the fusing component 102 may be formed to include a thermally conductive material, such as aluminum, stainless steel, a polymer, or the like. The fusing component 102 may also include a coating or release layer to, for instance, prevent transfer of the printing material 204 onto the fusing component 102 from the medium 206. In any regard, the fusing component 102 may extend a length, e.g., in a direction that is into the page, that is sufficient to apply heat onto media having various sizes. For instance, the fusing component 102 may have a length that is sufficiently long to fuse a widest media that the printing system 200 may print.

The heater 110 may be disposed or housed within the fusing component 102 and may be in contact with the fusing component 102. In this regard, as the heater 110 becomes heated, heat from the heater 110 may be transferred to a region of the fusing component 102 through the contact and the region of the fusing component 102 may become heated. Heat from the heated region of the fusing component 102 may be applied to the printing material 204 to fuse the printing material 204 onto the medium 206. The substrate 112 may be fixedly mounted on an interior surface of the fusing component 102, for instance, through use of screws, rivets, adhesive, a bracket structure, or another suitable attachment mechanism.

The heater 110 may include a substrate 112 having a first surface 114 and a second surface 116. The second surface 116 may be angled with respect to the first surface 114, for instance, the substrate 112 may have a rectangular cross sectional shape with the first surface 114 and the second surface 116 being on adjacent sides of the substrate 112. By way of particular example, the substrate 112 may have a rectangular cross-section with dimensions that are between about 0.5 mm and about 1 mm thick and between about 5 mm and about 15 mm wide. In other examples, the substrate 112 may have other cross-sectional shapes, e.g., other polygonal shapes, a circular shape, an oval shape, or the like. For instance, the substrate 112 may have a triangular cross section in which a heating element may be provided on all three sides of the substrate 112. In any regard, the substrate 112 may be formed of an electrically insulative and thermally conductive material, e.g., a material that is a better thermal conductor than it is an electrical conductor. In some examples, the substrate 112 may be formed of a material that blocks conduction of over 99.99% of the electrical energy applied to the material. For instance, the substrate 112 may be formed of a ceramic material or other suitable material. By way of particular example, the substrate 112 may be formed of aluminum oxide.

The heater 110 may also include a first heating element 118 (which is also referenced herein as a first resistive element 118 and a first resistive heating element 118), and a second heating element 120 (which is also referenced herein as a second resistive element 120 and a second resistive heating element 120). In addition, the first heating element 118 may be attached to or may otherwise abut or be in contact with the first surface 114 and the second heating element 120 may be attached to or may otherwise abut or be in contact with the second surface 116. As shown in FIGS. 1A-2, the first surface 114 may be a top surface of the substrate 112 and the second surface 116 may be a bottom surface of the substrate 112.

Each of the first heating element 118 and the second heating element 120 may be formed of a resistor or resistive material. In addition, the first heating element 118 and the second heating element 120 may be mounted on or within the substrate 112 through any suitable fabrication technique. For instance, the first heating element 118 and the second heating element 120 may be formed as metal traces on the surfaces 114, 116 of the substrate 112. As another example, the first heating element 118 and the second heating element 120 may be printed on the surfaces 114, 116 through a 3D printing process. In any of these examples, the first heating element 118 and the second heating element 120 may each have a wire coil configuration, a serpentine configuration, or any other resistor forming configuration mounted on or within the surfaces 114, 116 of the substrate 112. As such, high electrical resistance is encountered, and therefore heat is produced, by the first heating element 118 when current passes through the first heating element 118. Likewise, high electrical resistance is encountered, and therefore heat is produced, by the second heating element 120 when current passes through the second heating element 120.

The first heating element 118 may be electrically connected to a first electrode 130 and a common electrode 132 via respective electrical conductor lines. The second heating element 120 may be electrically connected to a second electrode 134 and the common electrode 132 via respective electrical conductor lines. The common electrodes 132 may be connected to a common source line and the first electrode 130 and the second electrode 134 may be connected to respective drain lines or vice versa.

A power source (not shown) may be electrically connected to the first electrode 130, the second electrode 134, and the common electrodes 132. Electrical energy may pass through the first heating element 118 when an electric potential is applied across the first electrode 130 and the common electrode 132. Likewise, electrical energy may pass through the second heating element 120 when an electric potential is applied across the second electrode 134 and the common electrode 132. According to examples, electrical energy may individually be supplied to each of the first heating element 118 and the second heating element 120 to thus cause the first heating element 118 and the second heating element 120 to separately generate heat.

As also shown in FIG. 1B, the first heating element 118 may have a first length 140 and the second heating element 120 may have a second length 142, in which the second length 142 may be longer than the first length 140. In other examples, the second length 142 may be shorter than the first length 140 without departing from a scope of the apparatus 100 disclosed herein. In this regard, when electrical energy is applied across the first heating element 118, the first heating element 118 may heat a portion of the substrate 112 that may correspond to the first length 140. The heat from the first heating element 118 may also be conducted to a portion of the fusing component 102 that may correspond to the first length 140. In addition, when electrical energy is applied across the second heating element 120, the second heating element 120 may heat a portion of the fusing component 102 that may correspond to the second length 142.

According to examples, the portion of the fusing component 102 that may be heated may be controlled through control of the application of electrical energy to one of the first heating element 118 and the second heating element 120. Thus, for instance, when the medium 206 is a first size, electrical energy may be applied across (or equivalently, through) the first heating element 118 to fix the printing material 204 on the medium 206. Likewise, when the medium 206 is a second size, electrical energy may be applied across the second heating element 120 to fix the printing material 204 on the medium 206. As another example, when the printing material 204 covers a first width of the medium 206, electrical energy may be applied across the first heating element 118 and when the printing material 204 covers a second width of the medium 206, electrical energy may be applied across the second heating element 120 to fix the printing material 204 on the medium 206.

Figure 3A:
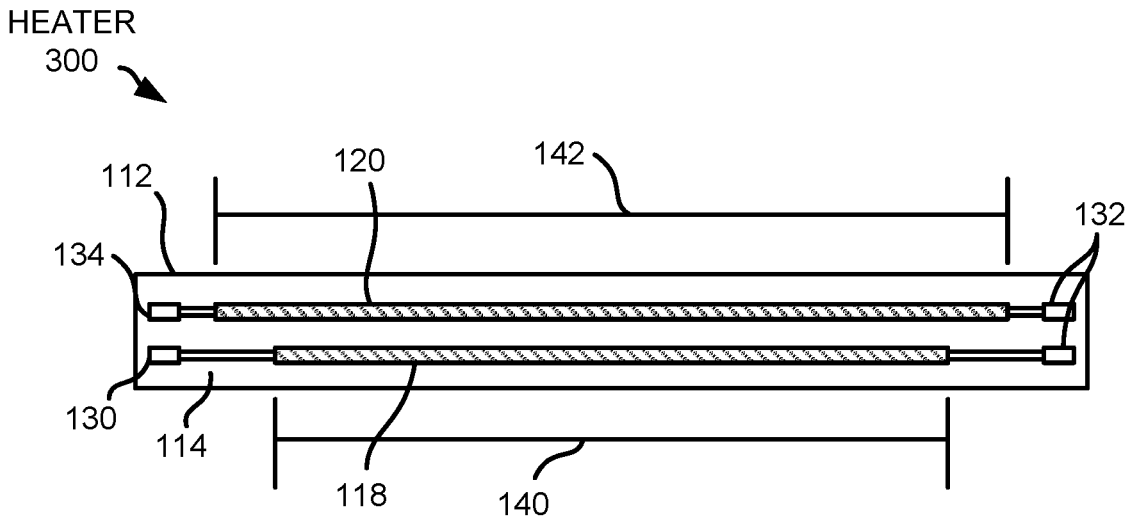
FIGS. 3A and 3B, respectively, depict a top view and a bottom view of an example heater having a plurality of heating elements of various lengths.
Figure 3B:
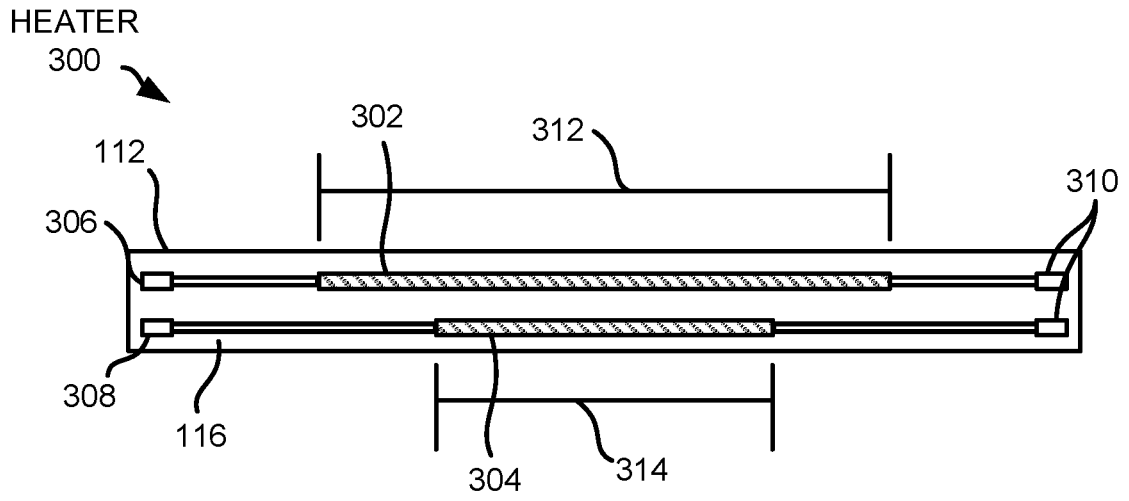

Although FIGS. 1A-2 depict the heater 110 as including a single heating element 118 on the first surface 114 and a single heating element 120 on the second surface 116 of the substrate 112, it should be understood that additional heating elements may be provided on either or both of the first surface 114 and the second surface 116 of the substrate 112 without departing from the scope of apparatus 100. An example heater 300 having additional heating elements is depicted in FIGS. 3A and 3B, in which the heater 300 may be in contact with an interior surface of the fusing component 102. Particularly, FIGS. 3A and 3B, respectively, depict a top view and a bottom view of the example heater 300. It should be understood that the example heater 300 depicted in FIGS. 3A and 3B may include additional components and that some of the components described herein may be removed and/or modified without departing from the scope of the example heater 300 disclosed herein.

As shown in FIG. 3A, the heater 300 may include a substrate 112 and both the first heating element 118 and the second heating element 120 may contact or be formed within a first surface 114 of the substrate 112. In addition, the first electrode 130, the second electrode 134, and the common electrodes 132 may respectively be connected to the first heating element 118 and the second heating element 120. As shown in FIG. 3B, a third electrode 302 and a fourth electrode 304 may contact or be formed within a second surface 116 of the substrate 112. As discussed herein, the second surface 116 may be located on an opposite side of the substrate 112 from the first surface 114. Thus, for instance, the first surface 114 may be a top surface of the substrate 112 and the second surface 116 may be a bottom surface of the substrate 112. In other examples, however, the first surface 114 may be a first side surface of the substrate 112 and the second surface 116 may be a second side surface of the substrate 112.

The third heating element 302 and the fourth heating element 304 may each be formed of a resistor or resistive material in manners similar to those discussed above with respect to the first heating element 118 and the second heating element 120. The third heating element 302 and the fourth heating element 304 may also be formed on or in the substrate 112 in manners similar to those discussed above with respect to the first heating element 118 and the second heating element 120. The third heating element 302 may be electrically connected to a third electrode 306 and the fourth heating element 304 may be electrically connected to a fourth electrode 308 via electrical conductor lines. The third heating element 302 and the fourth heating element 304 may also be electrically connected to a common electrode 310 vial electrical conductor lines. Electrical energy may be applied across each of the first heating element 118, the second heating element 120, the third heating element 302, and the fourth heating element 304 individually through application of electrical energy across respective ones of the electrodes 130, 134, 306, and 308 and the common electrodes 132, 310.

As shown, the third heating element 302 may have a third length 312 and the fourth heating element 304 may have a fourth length 314. The third length 312 and the fourth length 314 may differ from each other and from the first length 140 and the second length 142. For instance, the fourth length 314 may be shorter than the third length 312 and the third length 312 may be shorter than the first length 140. By way of particular example, the first length 140 may correspond to a first sized media, e.g., a letter sized media, and the second length 142 may correspond to a second sized media, e.g., an A4 sized media. In addition, the third length 312 may correspond to a section of the first sized media, e.g., a section of the letter sized media other than outside margins of the letter sized media. Furthermore, the fourth length 314 may correspond to a fourth sized media, e.g., an envelope. As used herein, the term "correspond" may be defined as being equivalent to and/or being within a certain length of the particular sized media.

Figure 4:
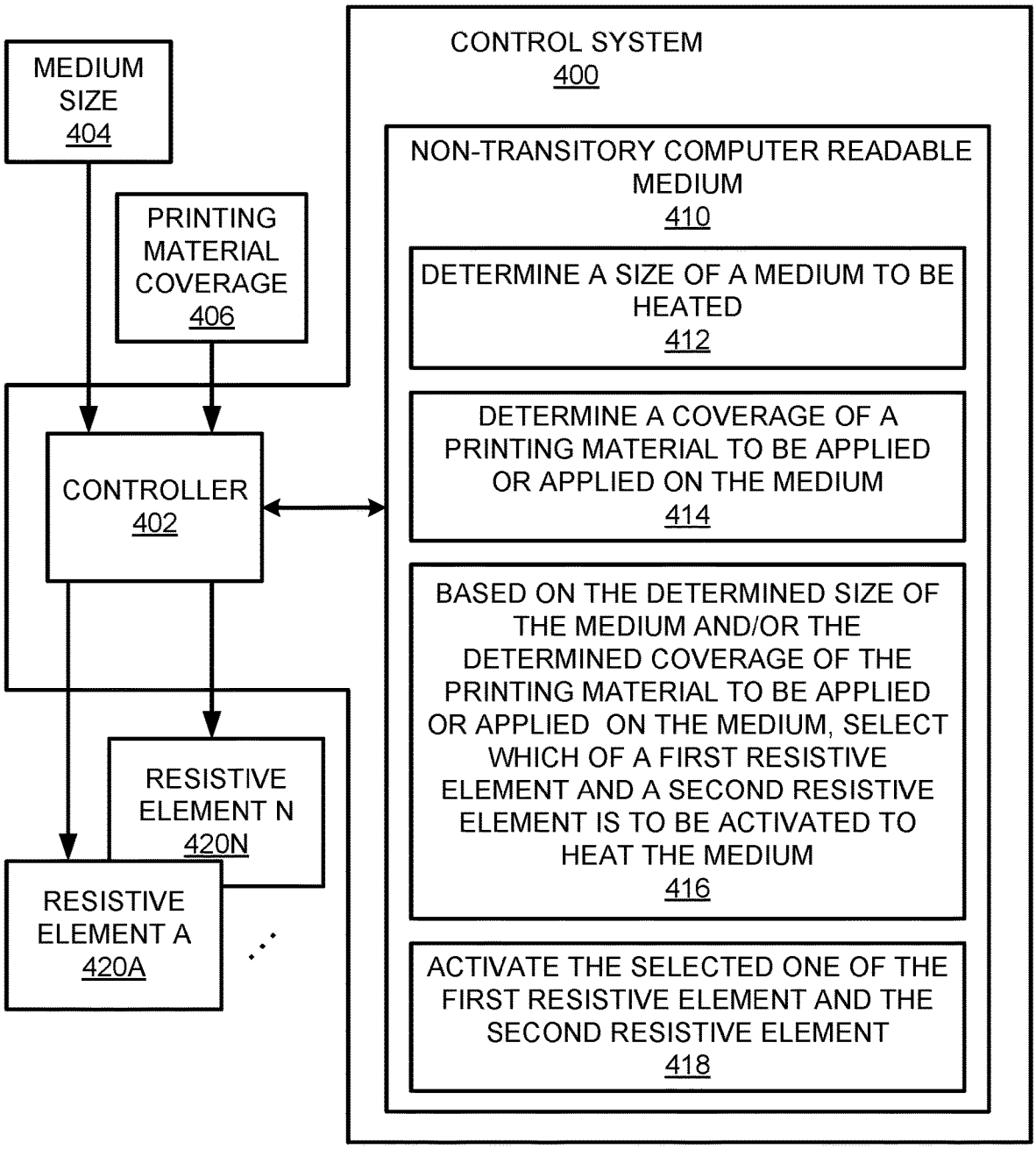
FIG. 4 shows a block diagram of an example control system that may activate one of a plurality of heating elements based on a size of a medium and/or a coverage of a printing material on a medium to be heated by the apparatus depicted in FIG. 1A.

Turning now to FIG. 4, there is shown a block diagram of an example control system 400 that may activate one of a plurality of heating elements 118, 120, 302, 304 based on a size of a medium 206 and/or a coverage of a printing material 204 on a medium 206 to be heated by the apparatus 100. It should be understood that the control system 400 depicted in FIG. 4 may include additional components and that some of the components described herein may be removed and/or modified without departing from the scope of the control system 400 disclosed herein. The description of the control system 400 is made with reference to FIGS. 1A-3B.

According to examples, the control system 400 may be part of the apparatus 100 and/or the printing system 200. In these examples, the control system 400 may be a control system of the printing system 200. In other examples, the control system 400 may be separate from the apparatus 100 and the printing system 200. In these examples, the control system 400 may be a computing device, such as a personal computer, a laptop computer, a tablet computer, a smart phone, or the like.

The apparatus 400 may include a controller 402 that may control operations of the control system 400 and a non-transitory computer readable medium 410. The controller 402 may be a semiconductor-based microprocessor, a central processing unit (CPU), an application specific integrated circuit (ASIC), a field-programmable gate array (FPGA), a graphics processing unit (GPU), a tensor processing unit (TPU), and/or other hardware device. The non-transitory computer readable medium 410 may have stored thereon machine readable instructions 412-418 (which may also be termed computer readable instructions) that the controller 402 may execute. The non-transitory computer readable medium 410 may be an electronic, magnetic, optical, or other physical storage device that contains or stores executable instructions. The-transitory computer readable medium 410 may be, for example, Random Access memory (RAM), an Electrically Erasable Programmable Read-Only Memory (EEPROM), a storage device, an optical disc, and the like. The term "non-transitory" does not encompass transitory propagating signals.

The controller 402 may fetch, decode, and execute the instructions 412 to determine a size of a medium 206 to be heated via the fusing component 102. The controller 402 may determine the size of the medium 206 to be heated through receipt of data that identifies the medium size 404. For instance, the printing mechanism 202 may detect the medium size 404 and may communicate that information to the controller 402.

The controller 402 may fetch, decode, and execute the instructions 414 to determine a coverage of a printing material 204 to be applied or applied on the medium 206. The controller 402 may determine the coverage of the printing material 204 to be applied or already applied on the medium 206 from the printing mechanism 202 or from another source. For instance, the coverage of the printing material 204 to be applied or applied on the medium 206 may be determined during a rasterization of an image to be printed onto the medium 206. In any regard, the controller 402 may access or receive the determined printing material coverage 406.

The controller 402 may fetch, decode, and execute the instructions 416 to select one of a first resistive element 420*a* and a second resistive element 420*b* to be activated based on the determined medium size 404 and/or the determined printing material coverage 406 of the printing material 204 to be applied or applied on the medium 206. In some examples, the controller 402 may select one of a plurality of resistive elements 420*a*-420*n* to be activated, in which the variable "n" may represent a value greater than 1. The resistive elements 420*a*-420*n* may be equivalent to the heating elements 118, 120, 302, 304 discussed herein. For instance, the controller 402 may select one of the plurality of heating elements 118, 120, 302, 304 depicted in FIGS. 3A and 3B to be activated to heat the printing material 204 on the medium 206.

Each of the resistive elements 420*a*-420*n* may have a different length with respect to each other. For instance, a first one of the resistive elements 420*a* may have a length that corresponds to a first sized media, e.g., a letter sized media, a second one of the resistive elements 420*b* may have a length that corresponds to a second sized media, e.g., an A4 sized media, a third one of the resistive elements 420*c* may have a length that corresponds to a third sized media, e.g., a section of a letter sized media that is within certain margins of the letter sized media, a fourth one of the resistive elements 420*d* may have a length that corresponds to a fourth sized media, e.g., an envelope size, etc. In addition, the resistive elements 420*a*-420*n* may be provided on multiple surfaces of a substrate 112 as discussed herein. The resistive elements 420*a*-420*n* may also be centered with respect to each other.

According to examples, the controller 402 may select the resistive element 420*a*-420*n* that may have a minimum length to apply heat onto all of the printing material 204 applied on a medium 206 as the medium 206 is moved past the apparatus 100. In other words, the controller 402 may select the resistive element 420*a*-420*n* having a length that most closely matches the width of the medium 206 and/or having a length that minimizes excess heating onto areas outside of a border of the medium 206 and/or a border of the printing material 204 coverage on the medium 206.

In an example in which the medium 206 is a letter sized medium, the controller 402 may select the first resistive element 420*a* as the first resistive element 420*a* may have a minimum length to apply heat across the entire width of the medium 206. In another example in which the medium 206 is an envelope, the controller 402 may select the fourth resistive element 420*d* as the fourth resistive element 420*d* may have a minimum length to apply heat across the entire width of the medium 206 as the medium 206 is moved past the apparatus 100. As a further example in which the medium 206 is an A4 sized medium on which printing material 204 is not to be applied onto margins of the medium 206, the controller 402 may select the third resistive element 420*c* as the third resistive element 420*c* may have a minimum length to apply heat across the width of the medium 206 that is to receive or has received printing material 204.

The controller 402 may fetch, decode, and execute the instructions 418 to activate the selected one of the resistive elements 420*a*-420*n*. That is, for instance, the controller 402 may cause a voltage (or equivalently, a current) to be applied across the selected resistive element 420*a*, e.g., through respective electrodes. Application of the voltage across the selected resistive element 420*a* may cause the resistive element 420*a* to become heated, which may also cause a portion of a fusing component 102 in contact with the heater 110 to be heated. The portion of the fusing component 102 may have a length that is nearly equivalent to the length of the selected resistive element 420*a*. In addition, heat from the fusing component 102 may be applied onto the printing material 204 as the medium 206 is moved past the fusing component 102.

Although the control system 400 has been depicted as including machine-readable instructions 412-418 that a controller 402 may execute, in other examples, a hardware device, e.g., an integrated circuit, may execute the functions denoted by the instructions 412-418. In these examples, the instructions 412-418 may be directly programmed into the controller 402. In other examples, the instructions 412-418 may be a combination of hardware and software instructions.

Figure 5:
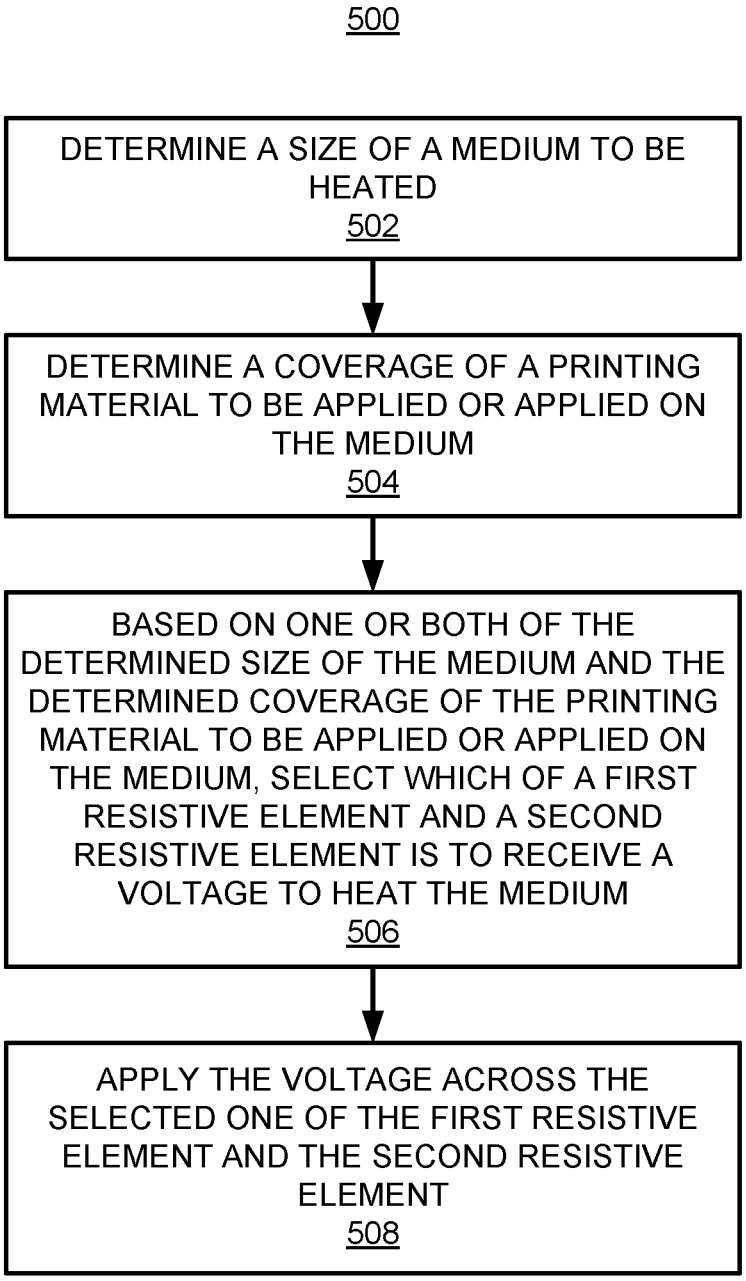
FIG. 5 shows an example method for activating one of a plurality of resistive elements having various lengths based on a size of a medium and/or a coverage of a printing material on the medium to be heated by the apparatus depicted in FIG. 1A.

Various manners in which the control system 400 and the apparatus 100 may be implemented are discussed in greater detail with respect to the method 500 depicted in FIG. 5. Particularly, FIG. 5 depicts an example method 500 for activating one of a plurality of resistive elements 420*a*-420*n* having various lengths based on a size of a medium 206 and/or a coverage of a printing material 204 on the medium 206 to be heated by an apparatus 100. It should be apparent to those of ordinary skill in the art that the method 500 may represent a generalized illustration and that other operations may be added or existing operations may be removed, modified, or rearranged without departing from a scope of the method 500.

The description of the method 500 is made with reference to the apparatus 100, the printing system 200, and the control system 400 illustrated in FIGS. 1A-4 for purposes of illustration. It should be understood that apparatuses, printing systems, and/or control systems having other configurations may be implemented to perform the method 500 without departing from a scope of the method 500.

At block 502, the controller 402 may determine a size of a medium 206 to receive heat. The controller 402 may determine the medium size 404 as discussed herein. At block 504, the controller may determine a coverage of a printing material 204 to be applied or applied on the medium 206. The controller 402 may determine the printing material coverage 406 as discussed herein.

At block 506, the controller 402 may, based on one or both of the determined size 404 of the medium 206 and the determined coverage 406 of the printing material 204 to be applied or already applied on the medium 206, select which of a first resistive element 420*a* and a second resistive element 420*b* is to receive a voltage to heat the medium 206. As discussed herein, the first resistive element 420*a* (e.g., the first heating element 118) may be positioned on a first surface 114 of a substrate 112 and may have a first length 140 and the second resistive element 420*b* (e.g., the second heating element 120) may be positioned on a second surface 116 of the substrate 112 and may have a second length 142. The controller 402 may select the resistive element 420*a*, 420*b* to be activated in any of the manners discussed herein.

At block 508, the controller 402 may apply the voltage across the selected one of the first resistive element 420*a* and the second resistive element 420*b* to heat the printing material 204 on the medium 206. That is, the controller 402 may cause the voltage to be applied across respective electrodes to which the selected one of the first resistive element 420*a* and the second resistive element 420*b* are electrically connected. Application of the voltage may cause the first resistive element 420*a* or the second resistive element 420*b* to become heated and the heat may be conducted through the fusing component 102 onto the printing material 204.

Although described specifically throughout the entirety of the instant disclosure, representative examples of the present disclosure have utility over a wide range of applications, and the above discussion is not intended and should not be construed to be limiting, but is offered as an illustrative discussion of aspects of the disclosure.

What has been described and illustrated herein is an example of the disclosure along with some of its variations. The terms, descriptions and figures used herein are set forth by way of illustration only and are not meant as limitations. Many variations are possible within the spirit and scope of the disclosure, which is intended to be defined by the following claims—and their equivalents—in which all terms are meant in their broadest reasonable sense unless otherwise indicated.

What is claimed is:

1. An apparatus comprising:

a fusing component having a housing;

a heater disposed in the housing of the fusing component, the heater including:

a substrate having a first surface and a second surface;

a first heating element having a first length attached to the first surface of the substrate;

a second heating element having a second length attached to the first surface of the substrate;

a third heating element having a third length attached to the second surface of the substrate; and a fourth heating element having a fourth length attached to the second surface of the substrate, wherein the first length, the second length, the third length, and the fourth length are different from each other.

2. The apparatus of claim 1, wherein the substrate comprises a ceramic substrate.

3. The apparatus of claim 1, further comprising:

a controller to selectively control activation of one of the first heating element, the second heating element, the third heating element, and the fourth heating element for a heating operation.

4. The apparatus of claim 1, wherein the first surface extends along a first plane and the second surface extends along a second plane, and wherein the second plane is angled with respect to the first plane.

5. The apparatus of claim 1, wherein the heater is in contact with an interior surface of the housing of the fusing component.

6. The apparatus of claim 1, wherein the first heating element, the second heating element, the third heating element, and the fourth heating element are centered with respect to each other.

7. The apparatus of claim 6, wherein the first heating element is sized for a first medium having a first size, the second heating element is sized for a second medium having a second size, the third heating element is sized for a portion of the first medium, and the fourth heating element is sized for a portion of the second medium.

8. The apparatus of claim 6, further comprising:

a controller to:

determine a size of a medium to receive heat via the fusing component;

determine a coverage of a printing material to be applied on the medium;

select one of the first heating element, the second heating element, the third heating element, and the fourth heating element to be activated based on the determined size of the medium or the determined coverage of the printing material to be applied on the medium; and activate the selected heating element to heat the printing material applied on the medium.

9. A method comprising:

determining, by a controller, a size of a medium to receive heat;

determining, by the controller, a coverage of a printing material to be applied on the medium;

based on the determined size of the medium and the determined coverage of the printing material to be applied on the medium, selecting, by the controller, which of a first resistive element, a second resistive element, a third resistive element, and a fourth resistive element is to receive a voltage to heat the medium, the first resistive element and the second resistive element being positioned on a first surface of a substrate, the third resistive element and the fourth resistive element being positioned on a second surface of the substrate, and the first resistive element, the second resistive element, the third resistive e merit and the fourth resistive element having different lengths; and apply, by the controller, the voltage across the selected resistive element to heat the printing material on the medium.

10. The method of claim 9, further comprising:

determining whether the printing material is to be printed on a margin of the medium;

based on a determination that the printing material is to be printed on the margin of the medium, selecting the first resistive element on the first surface of the substrate to receive the voltage to heat the printing material on the medium; and based on a determination that the printing material is not to be printed or is not printed on the margin of the medium, selecting the third resistive element on the second surface of the substrate to receive the voltage to heat the printing material on the medium.

11. The method according to claim 9, further comprising:

determining whether the determined size of the medium is below a predefined size;

based on a determination that the determined size of the medium is below the predefined size, selecting the second resistive element on the first surface of the substrate to receive the voltage to heat the printing material on the medium; and applying the voltage across the second resistive element to heat the printing material on the medium.

12. The method of claim 9, wherein selecting which of the first resistive element, the second resistive element, the third resistive element, and the fourth resistive element is to receive the voltage further comprises selecting one of the first resistive element, the second resistive element, the third resistive element, or the fourth resistive element that has a minimum length to meet the determined coverage of the printing material.

13. An apparatus comprising:

a fusing component; and a heater in thermal contact with the fusing component, the heater including:

a substrate having a first surface and a second surface, the substrate being electrically insulative and thermally conductive;

a first resistive heating element abutting the first surface and having a first length;

a second resistive heating element abutting the first surface and having a second length;

a third resistive heating element abutting the second surface and having a third length; and a fourth resistive heating element abutting the second surface and having a fourth length, wherein the first length, the second length, the third length, and the fourth length are different from each other.

14. The apparatus of claim 13, wherein the first resistive heating element, the second resistive heating element, the third resistive heating element, and the fourth resistive heating element are centered with respect to each other.

15. The apparatus of claim 13, further comprising:

a controller to:

determine a size of a medium to receive heat;

determine a coverage of a printing material to be applied on the medium;

select one of the first resistive heating element, the second resistive heating element, the third resistive heating element, and the fourth resistive heating element to receive a voltage to heat the printing material applied on the medium based on the determined size of the medium and the determined coverage of the printing material to be applied on the medium; and apply the voltage across the selected resistive heating element to heat the printing material on the medium.

* * * * *